US006029548A

United States Patent [19]

Hsieh

[11] Patent Number: 6,029,548

[45] Date of Patent: Feb. 29, 2000

[54] ADJUSTABLE WRENCH

[76] Inventor: Chih-Ching Hsieh, No. 64, Lane 107, Liang Tsun Rd., Fong Yuan City, Taichung Hsien, Taiwan

[21] Appl. No.: 09/078,560

[22] Filed: May 14, 1998

[51] Int. Cl.[7] ..... B25B 13/16

[52] U.S. Cl. ..... 81/166; 81/186

[58] Field of Search ..... 7/139; 81/65, 90.9, 81/100, 126, 128, 129, 155, 156, 160, 179, 186

[56] References Cited

U.S. PATENT DOCUMENTS

| | | | |
|---|---|---|---|
| 12,935 | 5/1855 | Coburn | 81/166 |
| 1,359,403 | 11/1920 | Lynds | 81/166 |
| 2,365,627 | 12/1944 | Cook | 81/128 |
| 2,376,764 | 5/1945 | Flower | 81/166 |
| 4,520,699 | 6/1985 | Jeremic | 81/166 |
| 5,415,064 | 5/1995 | Chang | 18/166 |
| 5,476,024 | 12/1995 | Hsieh | 81/121.1 |

FOREIGN PATENT DOCUMENTS

| | | | |
|---|---|---|---|
| 475919 | 6/1915 | France | 81/166 |
| 244119 | 3/1947 | Switzerland | 81/166 |

*Primary Examiner*—James G. Smith
*Assistant Examiner*—David B. Thomas
*Attorney, Agent, or Firm*—Varndell & Varndell, PLLC

[57] ABSTRACT

An adjustment wrench includes a movable pawl device mounted in an oval head of a wrench body thereof, and an adjustment nut rotated to move the pawl device in and out of a work hole in the oval head so as to hold down or release the workpiece to be turned with the wrench, wherein the oval head of the wrench body has alternatively arranged flat wall portions and teeth within the work hole, the pawl device has a V-shaped chucking head with a V-shaped chuck face for acting with the flat wall portions and teeth on the inside of the oval head of the wrench body to hold down the workpiece to be turned, the V-shaped chucking head having both ends slidably supported on two opposite side walls of the oval head of the wrench body by spring-supported steel balls.

2 Claims, 7 Drawing Sheets

ADJUSTABLE WRENCH

BACKGROUND AND SUMMARY OF THE INVENTION

The present invention relates to an adjustable wrench, and more particularly to such an adjustable wrench which can be stably and conveniently adjusted to hold down any of a variety of bolts and nuts of different sizes.

A variety of wrenches have been disclosed for grasping and turning nuts, bolts, etc., and have appeared on the market. FIG. 1 shows a box end wrench according to the prior art. This structure of box end wrench has two boxes at both ends for grasping and turning nuts, bolts, etc. Because the work hole defined within each box of the box end wrench is not adjustable, the box at each end of the box end wrench is practical for grasping and turning only one Particular size of nuts, bolts, etc. In order to fit different sizes of nuts, bolts, etc., adjustable wrenches are developed.

FIGS. from 2 to 4 show three different structures of adjustable wrench. These adjustable wrenches commonly comprises a wrench body having a work head at one end defining a work hole, a movable pawl device mounted in the work head of the wrench body, and a nut mounted in a hole or open chamber on the work head of the wrench body and rotated to move the movable pawl device in or out of the work hole so as to grasp or release the workpiece.

The pawl device of the adjustable wrench shown in FIG. 2 has a circular chucking head. When the circular chucking head of the pawl device is Roved forwards and pressed against the periphery of the workpiece, only a part of the front chucking face of the circular chucking head is retained in close contact with the periphery of the workpiece, therefore the circular chucking head tends to slip on the periphery of the workpiece when the wrench is turned with the hand.

The adjustable wrench shown in FIG. 3 is not durable in use because the pawl device and the work head of the wrench body are disposed at different elevations. Furthermore, because the adjustment nut is disposed on the outside of the work head of the wrench body, it tends to be covered with rust.

The adjustable wrench shown in FIG. 4 is known in the prior art. However, this structure of adjustable wrench still has drawbacks. This structure of adjustable wrench is not practical for grasping and turning small nuts, bolts, etc., because the chucking head of the pawl device has a great thickness. Furthermore, because the chucking face of the chucking head of the pawl device has a smooth surface, the work head of the wrench body may slip on the periphery of the workpiece when the wrench is turned with the hand.

The present invention has been accomplished to provide an adjustable wrench which eliminates the aforesaid drawbacks. It is the main object of the present invention to provide an adjustable wrench which can be conveniently operated to positively grasp and turn different sizes of nuts, bolts, etc. According to one aspect of the present invention, the work head of the wrench body of the adjustable wrench has flat wall portions and teeth alternatively arranged with the work hole therein for acting with the pawl device to hold down the workpiece positively, and the pawl device has a substantially V-shaped chucking head comprised of a flat surface portion and a serrated portion moved with the pawl device to force the workpiece against the flat wall portions and teeth inside the work head of the wrench body, enabling the workpiece to be firmly secured to the work head of the wrench body and turned. According to another aspect of the present invention, the V-shaped chucking head has both ends slidably supported on two opposite side walls of the oval head of the wrench body by spring-supported steel balls. Therefore, the pawl device can be stably moved in and out of the work hole in the work head of the wrench body.

DETAILED DESCRIPTION OF THE PREFERRED EMBODIMENT

Figure 1:
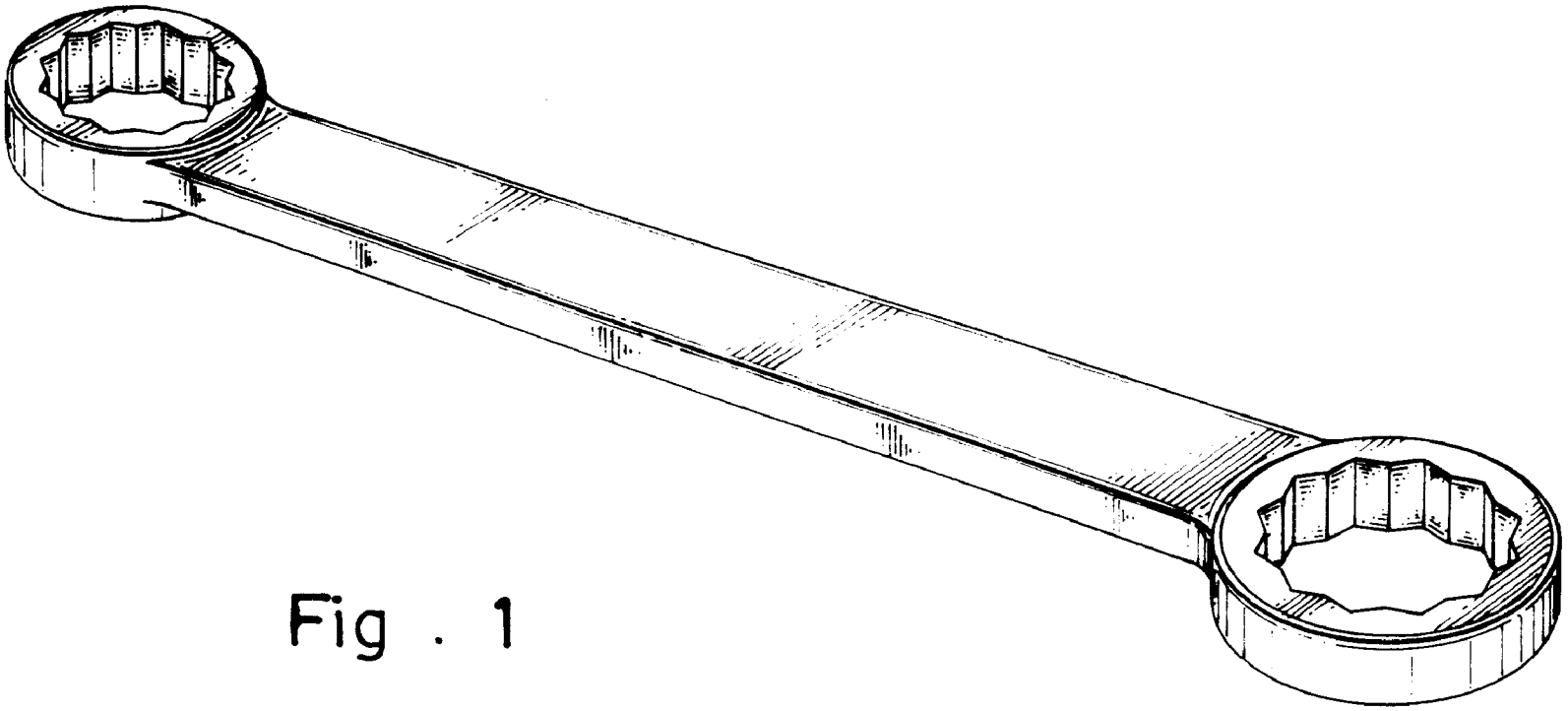
Fig. 1 PRIOR ART
FIG. 1 is a perspective view of a ratchet box end wrench according to the prior art.
Figure 2:
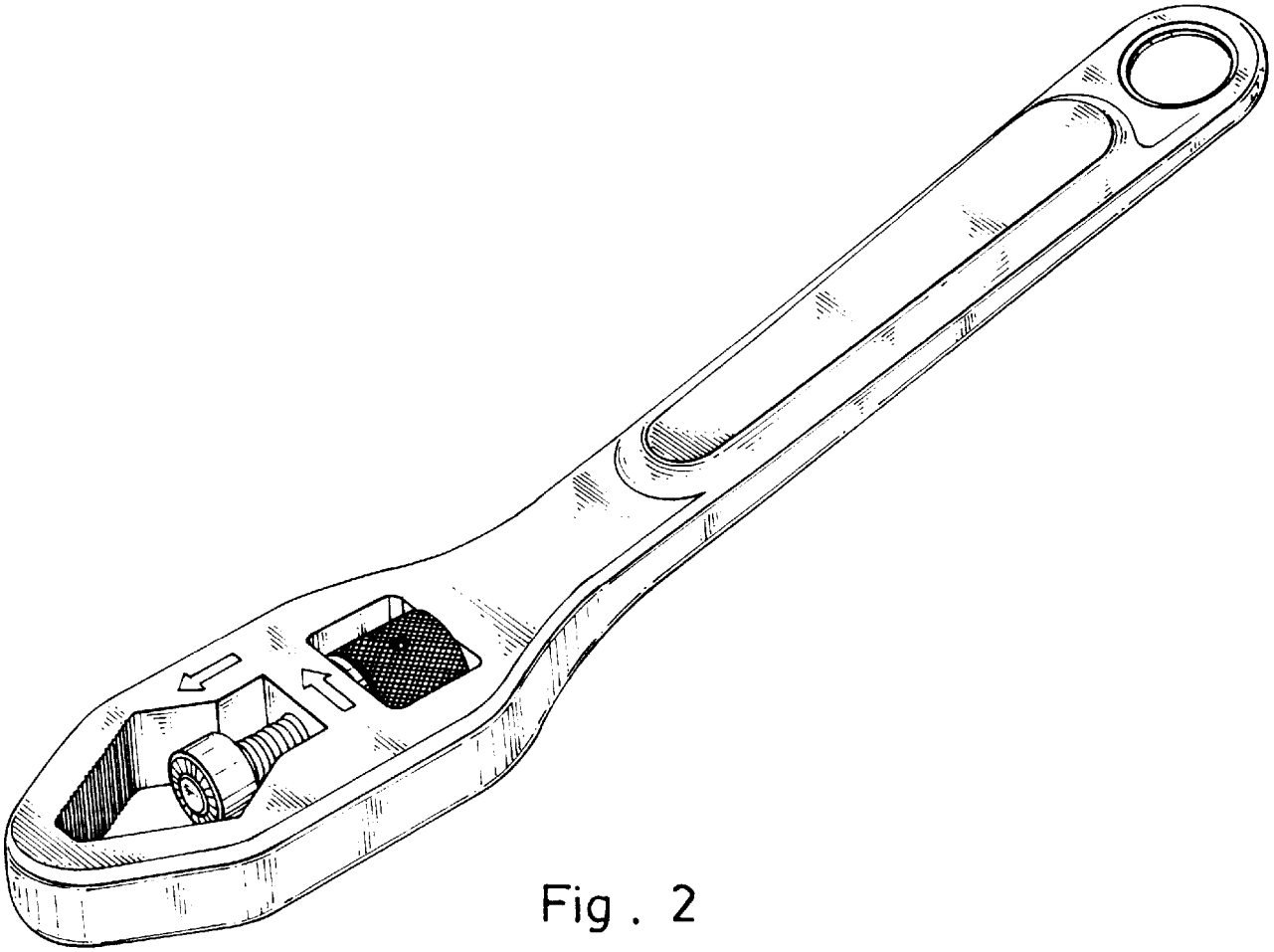
Fig. 2 PRIOR ART
FIG. 2 is a perspective view of an adjustable wrench according to the prior art.
Figure 3:
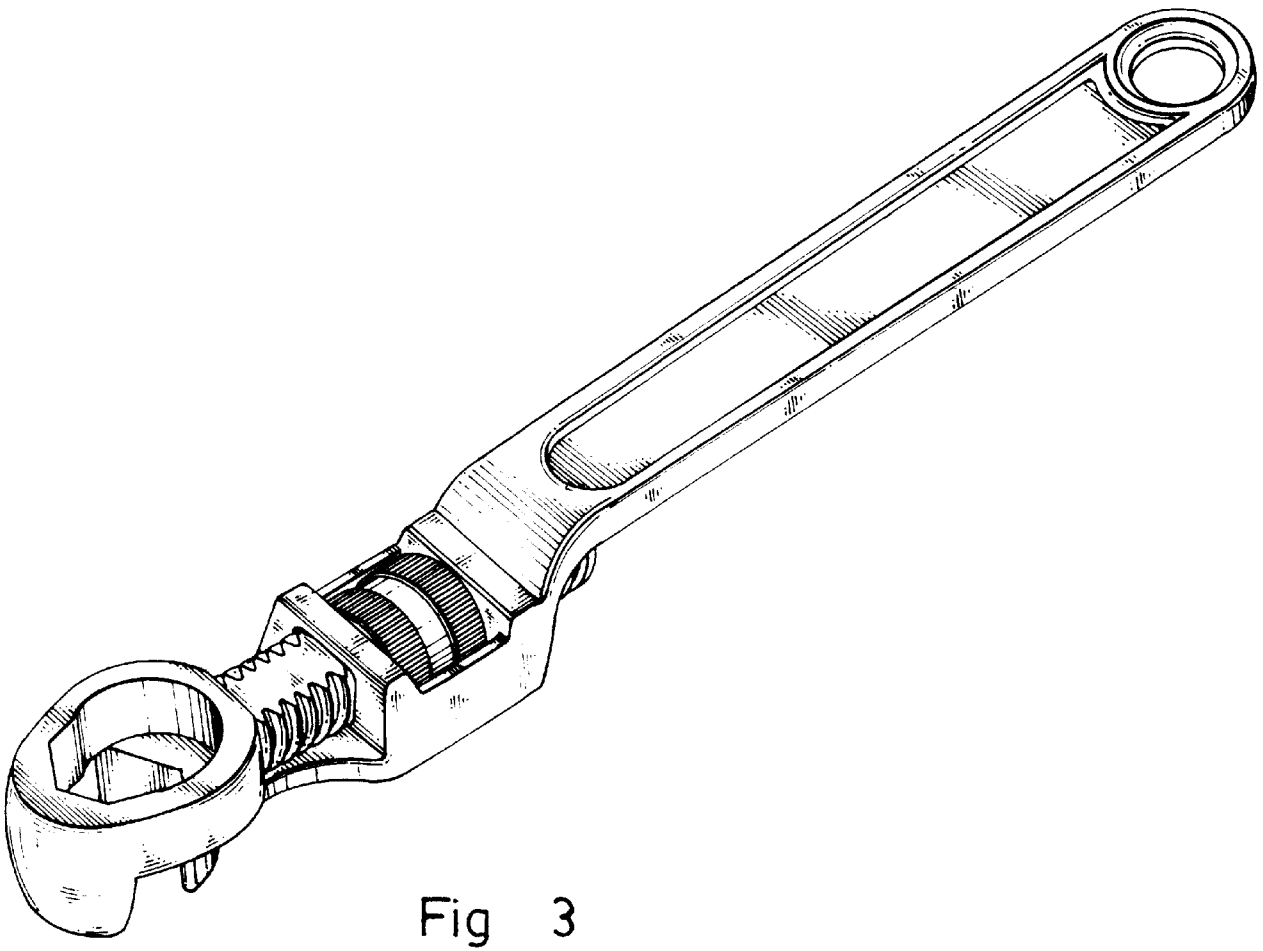
Fig 3 PRIOR ART
FIG. 3 is a perspective view of another structure of adjustable wrench according to the prior art.
Figure 4:
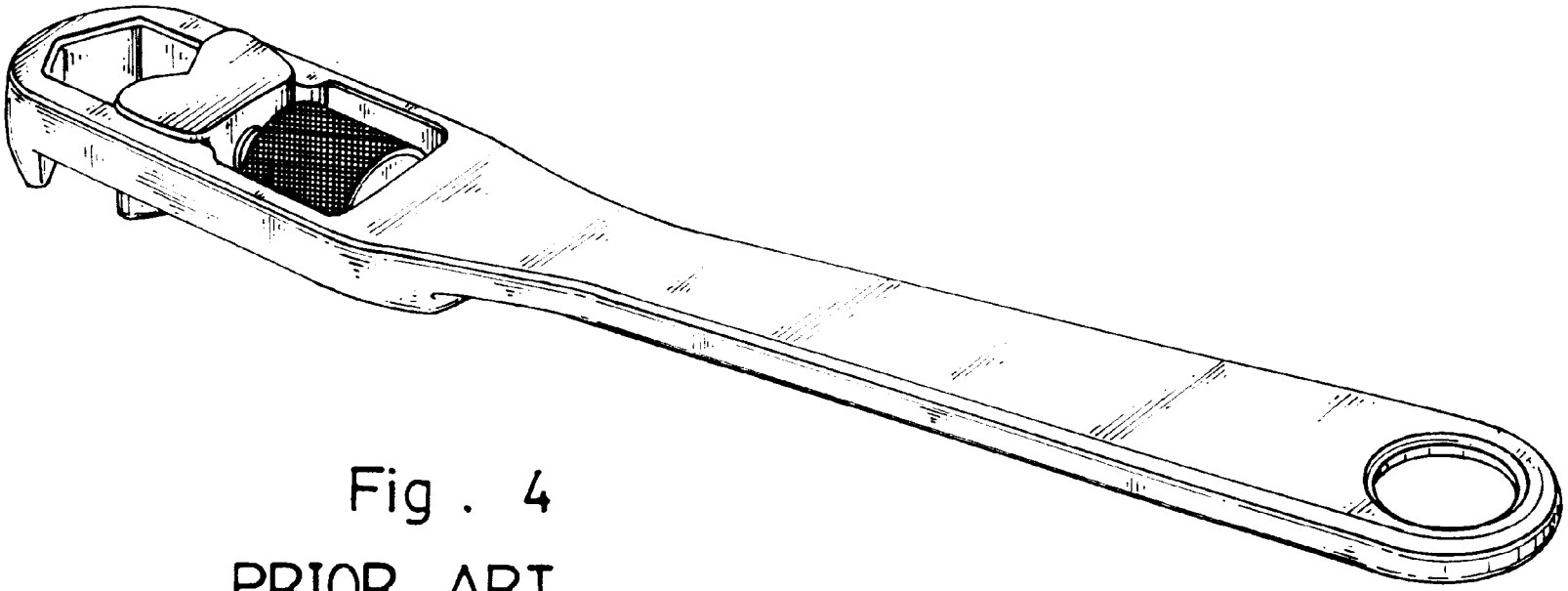
Fig. 4 PRIOR ART
FIG. 4 is a perspective view of still another structure of adjustable wrench according to the prior art.
Figure 5:
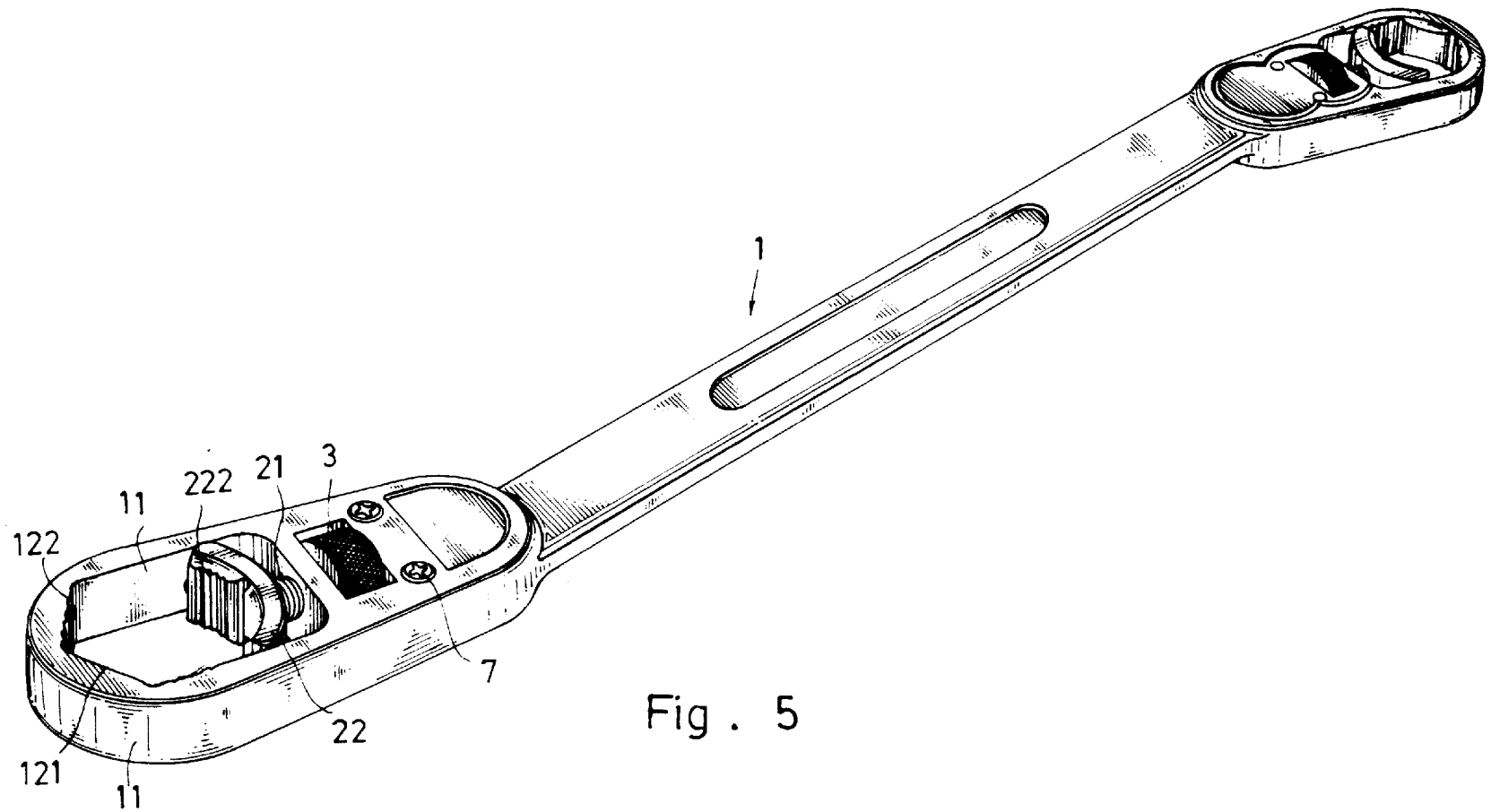
FIG. 5 is a perspective view of an adjustable wrench according to the present invention.
Figure 6:
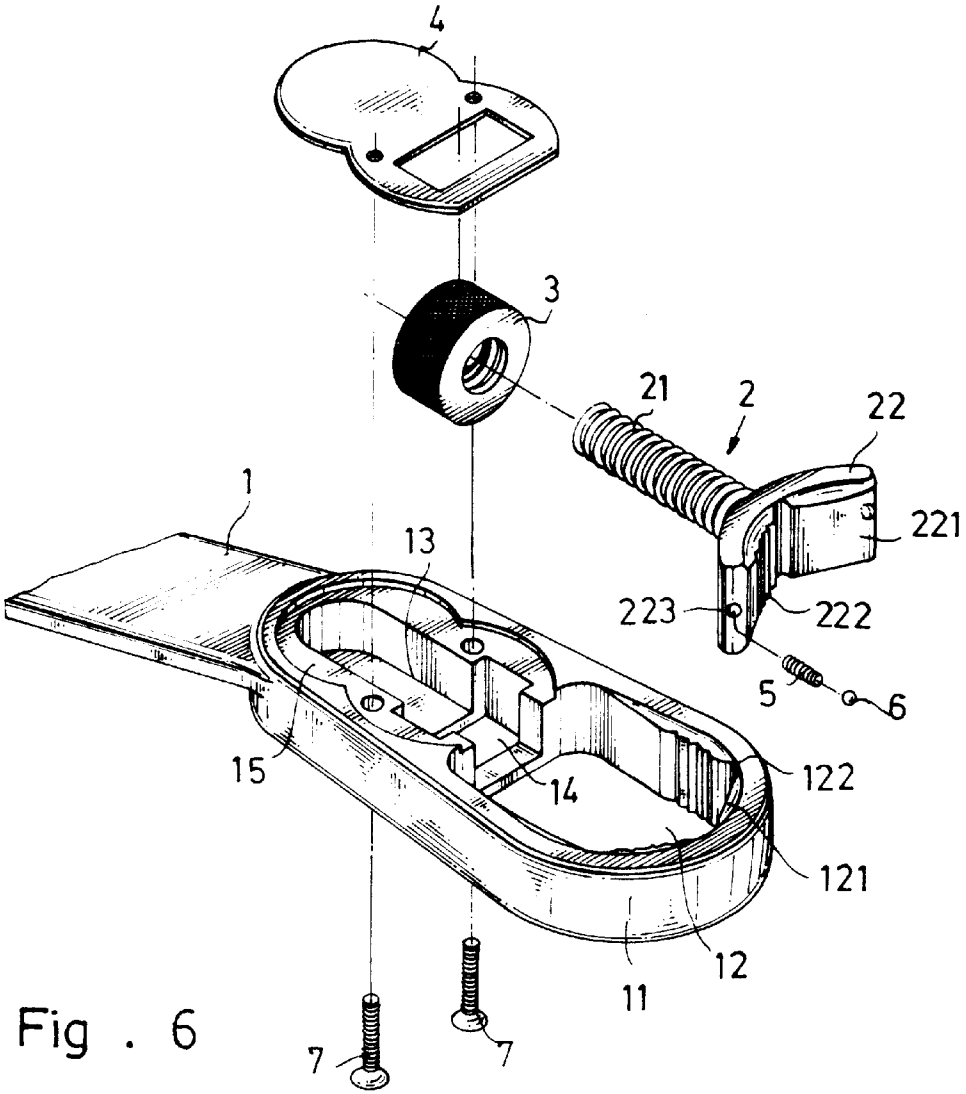
FIG. 6 is an exploded view of the adjustable wrench shown in FIG. 5.

Referring to FIGS. 5 and 6, an adjustable wrench in accordance with the present invention is generally comprised of an elongated body 1, a movable pawl device 2, an adjustment nut 3, and a locating plate 4.

The body 1 comprises an oval head 11 at one end. The oval head 11 comprises a work hole 12, a receiving chamber 13, a nut hole 14 disposed between the work hole 12 and the receiving chamber 13, a plurality of flat wall portions 121 and teeth 122 alternatively spaced within the work hole 12, and a mounting groove 15 at one side around the receiving chamber 13, a plurality of flat wall portions 121 and teeth 122 alternatively spaced within the work hole 12, and a mounting groove 15 at one side around the receiving chamber 13. The locating plate 4 is fastened to the mounting groove 15 to hold the adjustment nut 3 in the nut hole 14, enabling the adjustment nut 3 to be rotated in the nut hole 14 on its own axis. The movable pawl device 2 is a substantially Y-shaped member comprised of a screw rod 21, and a V-shaped front chucking face 22 comprised of a flat surface portion 221 and a serrated portion 222, and two holes 223 at two opposite ends of the V-shaped chucking face 22. Two springs 5 are respectively mounted in the holes 223 to support a respective steel ball 6, enabling the steel ball 6 to partially project out of the respective hole 223.

Figure 7:
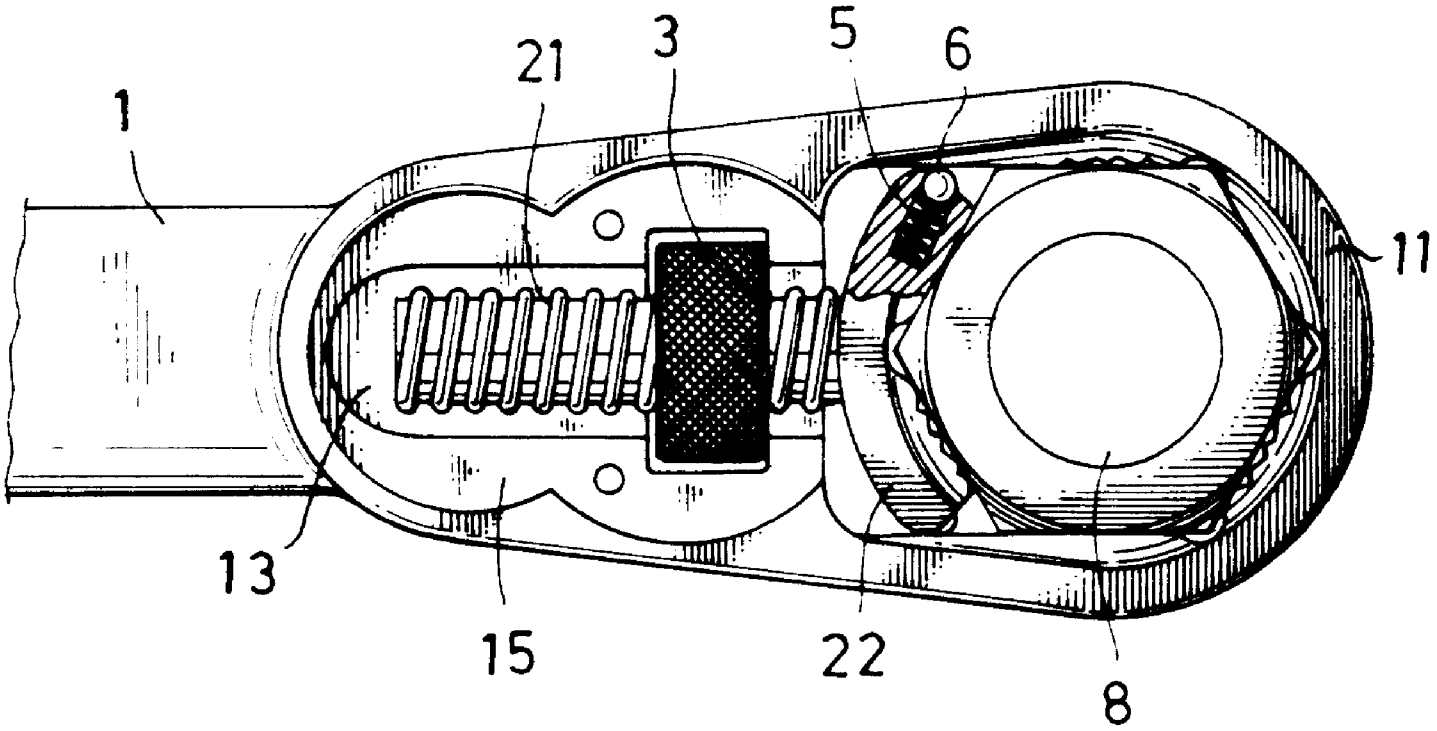
FIG. 7 is a sectional assembly view of the present invention.

Referring to FIG. 7, the adjustment nut 3 is threaded onto the screw rod 21 of the pawl device 2, then the pawl device 2 is mounted in the receiving chamber 13, permitting the adjustment nut to be inserted into the nut hole 14 and the steel balls 6 to be forced by the respective springs 5 into contact with the peripheral wall of the opening within the oval head 11, and then the locating plate 4 is fixedly fastened to the mounting groove 15 of the oval head 11 of the body 1 by screws 7 to hold the adjustment nut 3 in the nut hole 14. When assembled, the adjustment nut 3 partially Projecting out of the nut hole 14 for turning with the hand. When the work hole 12 is coupled to the workpiece 8, the adjustment nut 3 is rotated in one direction to move the pawl device 2 forwards, causing the workpiece 8 to be firmly secured between the flat surface portion 221 and serrated Portion 222 of the V-shaped chucking face 22 of the pawl device 2 and the flat wall portions 121 and teeth 122 of the oval head 11 of the body 1, and therefore the workpiece 8 can be positively turned with the wrench.

What is claimed is:

1. An adjustment wrench comprising a wrench body having a hollow oval head and a work hole defined within said oval head, a movable pawl device mounted in said hollow oval head and movable within said work hole to hold a workpiece, so that the workpiece can be turned with the wrench, and an adjustment nut mounted in said oval head and rotated to move said pawl device within said work hole, said oval head of said wrench body comprising a receiving chamber for receiving said pawl device, a nut hole disposed between said work hole and said receiving chamber for receiving said adjustment nut, a mounting groove at one side around said receiving chamber, and a locating plate fastened to said mounting groove for holding said adjustment nut in said nut hole;

said movable pawl device being a substantially Y-shaped member comprised of a screw rod onto which said adjustment nut is threaded, and a V-shaped chucking head integral with one end of said screw rod for holding the workpiece in said work hole, said V-shaped chucking head having a V-shaped front chucking face comprised of a flat surface portion and a serrated portion; and said V-shaped chucking head of said pawl device having two blind holes at two opposite ends thereof, two springs respectively mounted in said blind holes, and two steel balls respectively supported on said springs, said steel balls being partially forced out of the respective blind holes by said springs and abutting two opposite side walls inside said work hole of said oval head of said wrench body.

2. The adjustable wrench of claim 1 wherein the oval head of said wrench body comprises a plurality of flat wall portions and serrated wall portions alternatively spaced within said work hole remote from said nut hole for acting with the V-shaped front chucking face of said V-shaped chucking head of said pawl device to hold down the workpiece in said work hole.

* * * * *